United States Patent [19]

Schwab, Jr.

[11] Patent Number: 5,024,274

[45] **Date of Patent: * Jun. 18, 1991**

[54] METHOD AND APPARATUS FOR ENHANCED OIL RECOVERY

[75] Inventor: Carl M. Schwab, Jr., Bakersfield, Calif.

[73] Assignee: Otis Engineering Corp., Dallas, Tex.

[ * ] Notice: The portion of the term of this patent subsequent to Mar. 3, 2004 has been disclaimed.

[21] Appl. No.: 901,556

[22] Filed: Aug. 29, 1986

Related U.S. Application Data

[63] Continuation-in-part of Ser. No. 793,842, Nov. 1, 1985, Pat. No. 4,646,828.

[51] Int. Cl.[5] ..... E21B 43/24; E21B 34/08; E21B 23/03

[52] U.S. Cl. ..... 166/303; 166/117.5; 166/242; 166/269; 166/374; 166/386; 166/387

[58] Field of Search ..... 166/117.5, 117.6, 272, 166/303, 373, 374, 386, 387, 269, 57, 242

[56] References Cited

U.S. PATENT DOCUMENTS 4,295,796 10/1981 Moore ..... 166/117.5 X
4,462,465 7/1984 Strickland ..... 166/117.5
4,541,482 9/1985 Johnston ..... 166/117.5
4,553,310 11/1985 Logan ..... 166/117.5 X
4,646,828 3/1987 Schwab, Jr. et al. ..... 166/380 X

*Primary Examiner*—Stephen J. Novosad
*Attorney, Agent, or Firm*—Roland Cox; M. H. Gay

[57] ABSTRACT

An enhanced oil recovery well system and method providing for simultaneous heated vapor or hot liquid injection of usually water into one or more formations in a well through a single conduit. The well system utilizes injection mandrels selected to provide drier steam or wetter steam and hot water to inject for best recovery from a particular formation. One injection mandrel separates and collects wetter steam and hot water from injected steam flow and directs the wet steam and hot water flow through the mandrel while directing steam flow into a formation. The other mandrel has upper and lower means for separating and collecting wet steam and hot water and directs wet steam and hot water flow into a formation while directing steam flow through the mandrel. More than one mandrel may be used for each formation and control means may be installed in either mandrel to control flow into formations. Well systems are monitored and controlled for efficient operation and recovery.

54 Claims, 3 Drawing Sheets

FIG. 2A
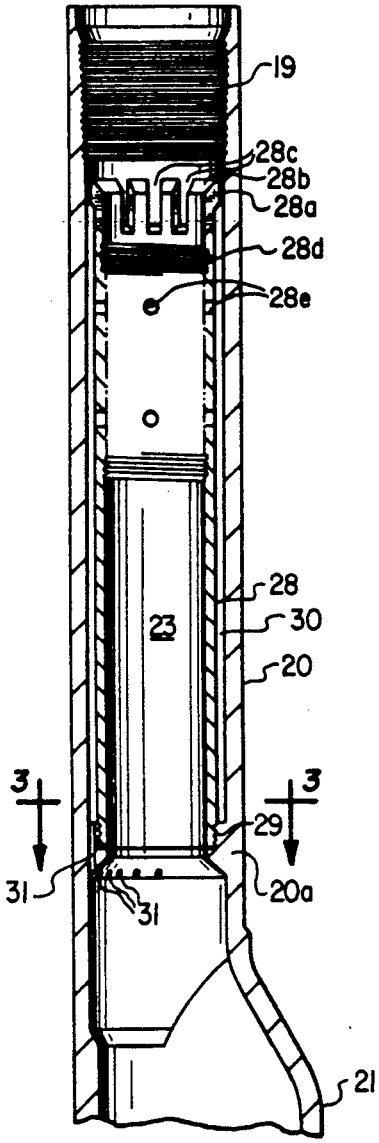
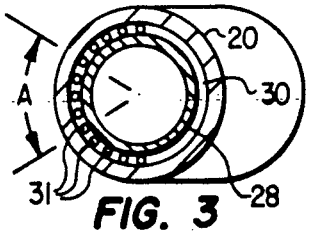
FIG. 3
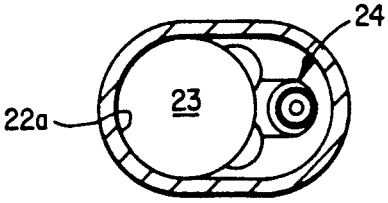
FIG. 4
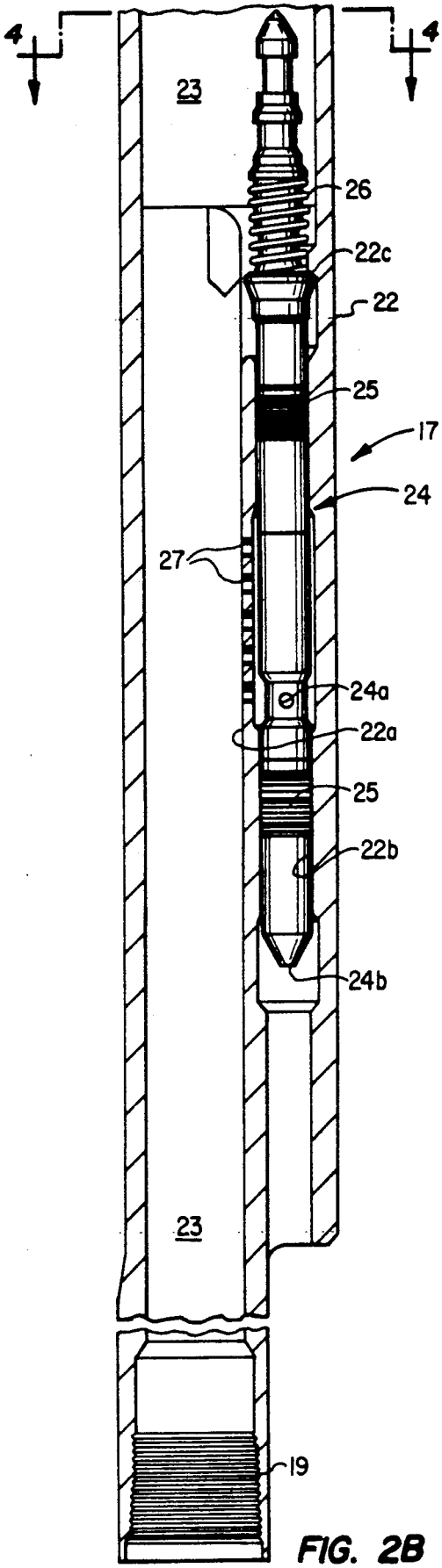
FIG. 2B

METHOD AND APPARATUS FOR ENHANCED OIL RECOVERY

This application is a continuation-in-part of our copending application, Ser. No. 793,842, now U.S. Pat. No. 4,646,828 issued Mar. 3, 1987.

BACKGROUND OF INVENTION

1. Field

This invention relates to the recovery of viscous petroleum from earth formations using an enhanced oil recovery technique. The invention more particularly relates to apparatus useful, in injection well systems to selectively provide vapor and/or liquid simultaneously to one or more formations encountered by the well bore through a single conduit.

2. Prior Art

One technique of enhanced oil recovery known as flooding involves injecting a heated fluid (usually water) into a central well to carry heat to formations in the well having viscous petroleum deposits. The heat reduces the petroleum viscosity, making it more fluid, and the injected steam and/or hot water moves the petroleum through the formations into surrounding well bores for flow to the surface.

Several United States Patents have addressed multiple formation injection utilizing heated fluids. Ronald K. Churchman U.S. Pat. No. 4,248,302 discloses completion techniques and apparatus to enhance petroleum recovery from more than one formation in a well using heated liquid. This system is operable in one or more formations in a well containing the most viscous petroleum deposits known as tar sands and utilizes injection mandrels with retrievable injection controls.

John R. Deming et al U.S. Pat. No. 4,595,057 sets forth a system and method of multiformation injection to deliver steam or hot water to two formations simultaneously. This invention requires two tubing strings for injection and does not include means for controlling injected flow.

My copending application for U. S. Patent, Serial No. 793,842, filed Nov. 1, 1985, now U.S. Pat. No. 4,646,828, discloses mandrels useful in a single injection conduit in a steam injection well to direct wet and dry steam exterior of the mandrels for flow into formations encountered by the well bore.

As different formations have widely differing characteristics, steam injection for efficient and most recovery of petroleum from a formation may require low or high heat delivery from drier steam or wetter steam and hot water. For example, a formation into which steam injection has just begun probably will require great quantities of heat from drier steam for efficient recovery. A formation which has been injected into for years may require heat in the form of great quantities of wetter steam and hot water for efficicent recovery of most viscous petroleum.

INVENTION SUMMARY

This invention provides an injection well system and method and two embodiments of an injection mandrel for use in tubing in the invention well system.

This well system is the first system known to me to provide for heated vapor and liquid injection into one or more formations in a well simultaneously through a single conduit and permits delivery of vapor and/or liquid to each formation for efficient and greatest recovery of viscous petroleum from that formation. The invention system also utilizes control devices which control fluid injection into each formation. As the invention well system provides for injection into multiple formations through one injection well, an expensive injection well is not required for each formation. When designing each well system, careful consideration must be given to formation characteristics and requirements and overall system parameters, to provide an efficient injection system which includes monitoring instrumentation and injection control. Each injection mandrel has internal means for separating injected steam flow into mostly drier steam and mostly wetter steam and hot water. One preferred mandrel embodiment separates, mixes and directs drier steam vapor flow through an offset receptacle to outside the mandrel and mostly liquid flow is directed downwardly to flow through the mandrel. Another preferred mandrel embodiment separates and directs wet steam and hot water flow through the offset receptacle to outside the mandrel, while the drier steam flow is directed downward through the mandrel and mixed. A retrievable valve, regulator venturi or choke controlling flow to outside the mandrel may be installed in the offset receptacle in either mandrel. Either or both mandrels may be utilized in a single conduit in the steam injection well system of this invention, to simultaneously deliver drier steam or wetter steam and heated water as required for best recovery of petroleum from each formation in the well. More than one mandrel may be used for each formation and, obviously, more than one conduit may be run in the well.

An object of this invention is to provide a well system for enhanced oil recovery which provides simultaneous injection of vapor and liquid into one or more formations in a well through a single conduit.

An object of this invention is to provide a system for an enchanced oil recovery steam injection well which injects heated water in the proper state for efficient and greatest recovery of petroleum from a formation.

An object of this invention is to provide a mandrel for the invention well system which separates, collects and directs mostly steam into a formation and mostly hot water downwardly through the mandrel.

Another object of this invention is to provide a mandrel for the invention well system which separates, collects and directs hot water into a formation and steam flow through the mandrel.

Also an object of this invention is to provide control of flow injected through a mandrel into each formation.

Another object of this invention is to provide a mandrel in which a retrievable flow control may be installed.

DRAWING DESCRIPTION

FIG. 1 is a schematic drawing of an enhanced oil recovery steam injection well utilizing the system of this invention.

FIGS. 2A and 2B together are a sectioned drawing in elevation of an embodiment of a mandrel useful in the well system of FIG. 1.

FIG. 3 is a drawing of a cross section of FIG. 2 viewed along line 3—3 in FIG. 2.

FIG. 4 is a drawing of another section of FIG. 2 viewed along line 4 in FIG. 2.

Figure 1:
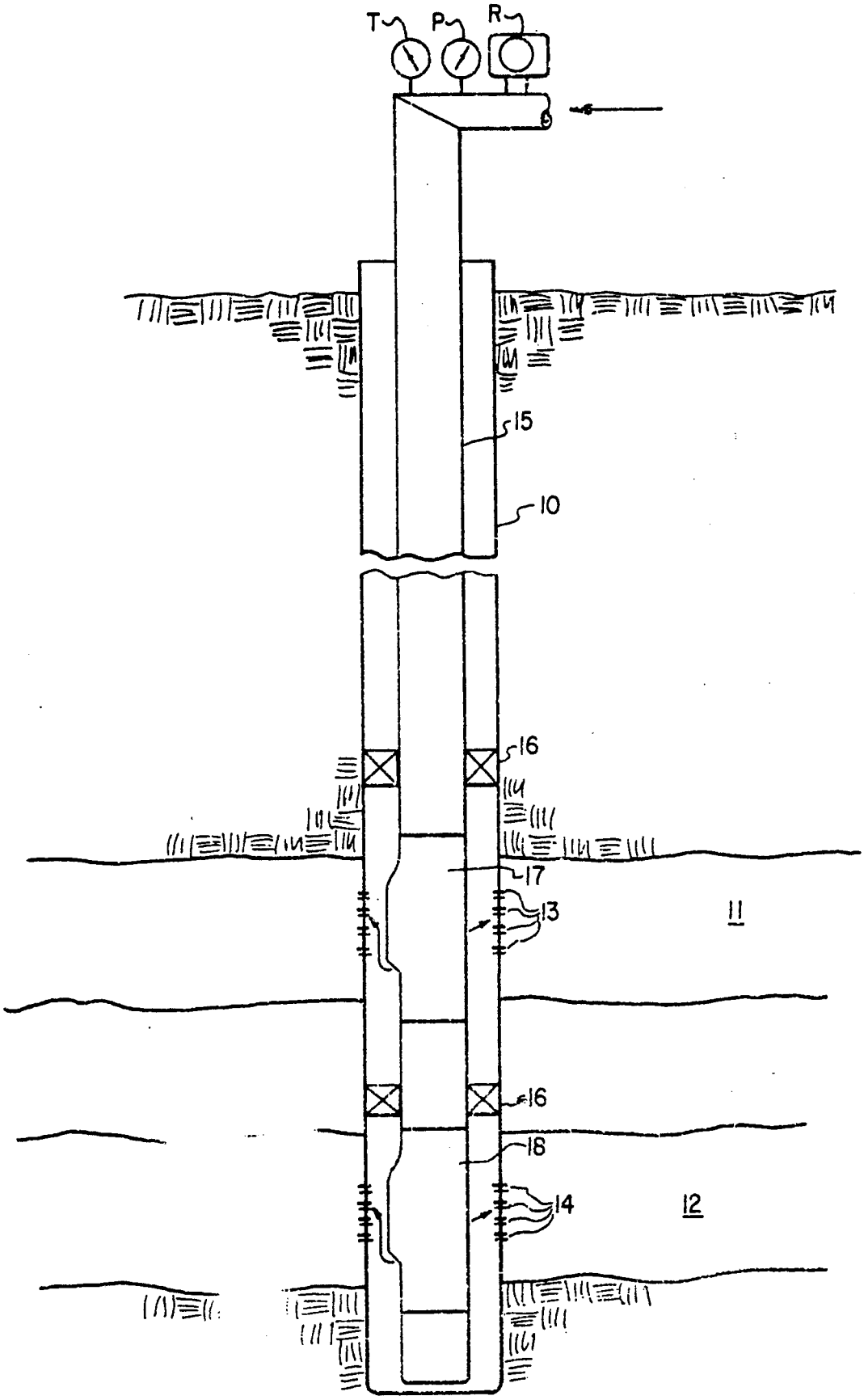
Figure 5A:
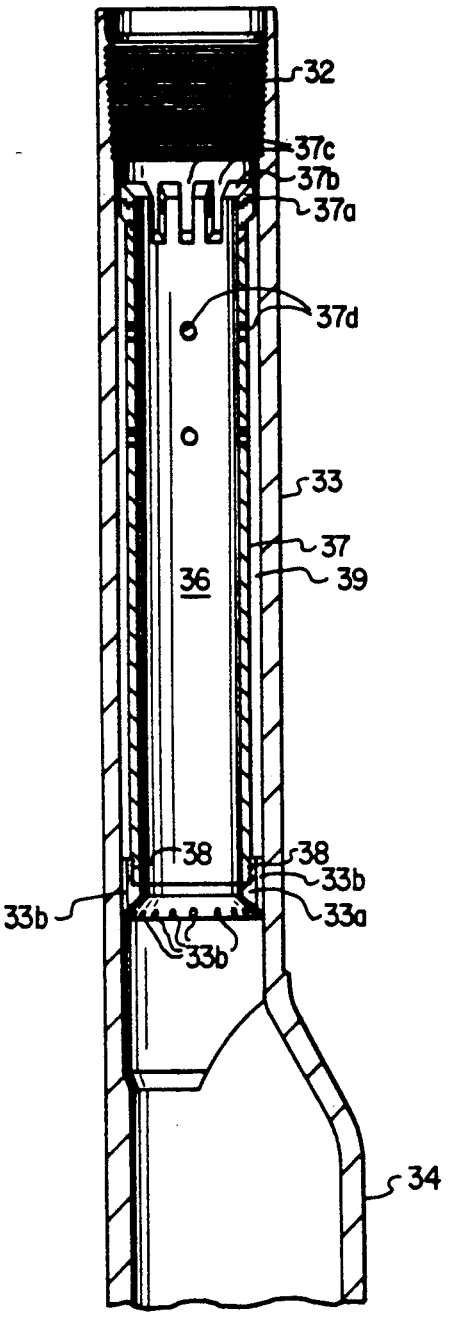
Figure 5B:
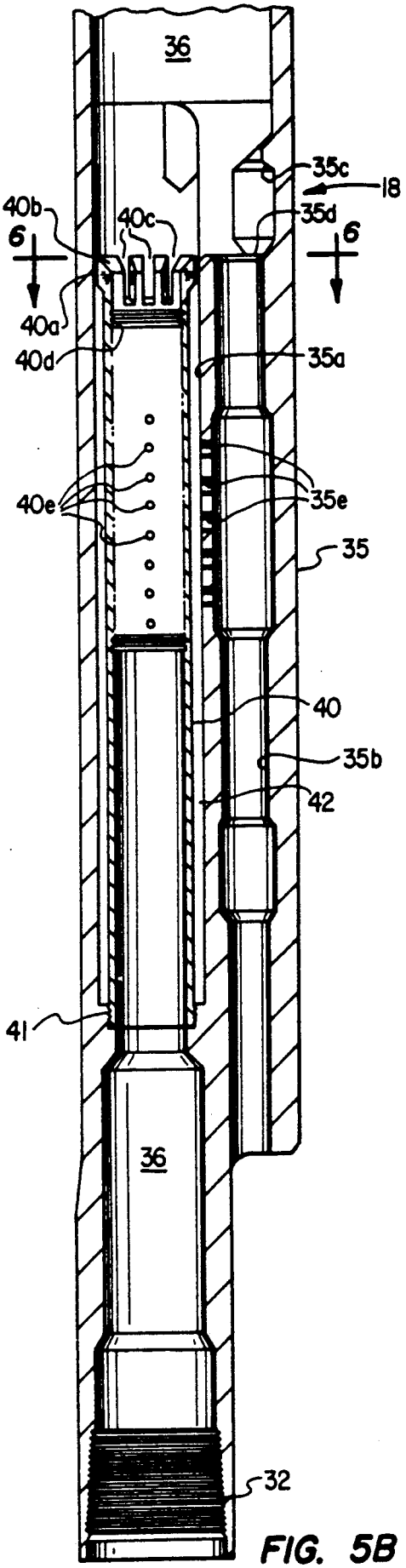

FIGS. 5A and 5B together are a sectioned drawing in elevation of another embodiment of a mandrel useful in the FIG. 1 system.

Figure 6:
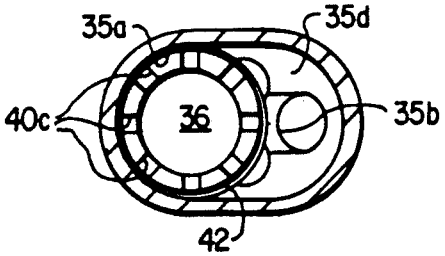

FIG. 6 is a drawing of a cross section of the mandrel of FIG. 4 viewed along section line 6—6 in FIG. 4.

BEST INVENTION MODE

FIG. 1 shows a steam injection well having casing 10 in a bored hole, which passes through formations 11 and 12 into which heated water is to be injected. The casing has been perforated at 13 and 14 to provide pressure communication between the formations and casing interior. A tubing conduit 15, which includes packers 16 and injection mandrels 17 and 18, has been lowered into the casing and the packers have been operated to seal between the tubing and casing and establish sealed annular regions for each formation. Mounted on the surface tubing are a meter R, which will measure the rate of flow through the tubing, a temperature gage T and pressure gage P. Gages T and P are useful to determine the temperature and pressure of flow through the tubing for injection into the formations. Mandrels 17 and 18 are selected to supply heated water in the proper state and quantity for greatest recovery of petroleum from each formation through producing wells. Formation characteristics may require mandrel 18 to be above mandrel 17. Steam is supplied in the tubing in sufficient quantity and at sufficient pressure for flow down the tubing through and out of the mandrels, into the annular regions and each formation. FIG. 1 shows a well having two formations for injection and shows one injection mandrel for each formation. A well could have one formation for injection and, if required for greater injected quantities, more than one mandrel could be used for each formation. It should also be apparent that the well system of FIG. 1 is not limited to the injection of steam into formations. Other mediums such as $CO_2$ or any combinations of gas vapor or liquid could be injected into well formations utilizing this system.

FIGS. 2A and 2B show one embodiment of the mandrel 17 of this invention, which separates mostly drier steam from the steam flow passing through the mandrel and directs drier steam exterior of the mandrel for injection into a formation requiring drier steam for best recovery. This mandrel has upper and lower threads 19 for connection in a well tubing string, a tube section 20 having an internal boss 20*a*, an upper body section 21, a lower body section 22 and a longitudinal flow passage 23. The lower body has a bore 22*a* concentric with the longitudinal flow passage, an offset receptacle having bore 22*b* communicating the inside of the body with the outside of the mandrel and a shoulder 22*c*. A retrievable flow control device 24 is shown installed in receptacle bore 22*b* in FIG. 2B. The control device has an inlet port 24*a* and a lower outlet 24*b*, and is sealed in the bore with upper and lower seals 25 and latched in place under shoulder 22*c* with releasable latch 26. This control device may contain any form of a valve, regulator venturi or a choke to control flow therethrough. Ports 27 provide communication between bores 22*a* and 22*b* in body 22.

Centrally disposed in body tube 20 is an inner tube 28 having an enlarged upper end 28*a*, an upper downwardly and inwardly inclined surface 28*b*, slots 28*c*, internal threads 28*d* and wall ports 28*e*. Tube 28 is connected in tube boss 20*a* with threads 29 to form an annulus 30 between tube section 20 and tube 28. Ports 31 are provided communicating the annulus with the inside of the upper body.

FIGS. 5A and 5B show another embodiment 18 of the mandrel useful in carrying out the present well system invention. Mandrel 18 separates mostly wet steam and liquid from the steam flow through, collects and directs the wetter steam and hot water flow exterior of the mandrel for injection into a formation requiring wetter steam and hot water injection for best recovery and directs the drier steam flow out the lower end of the mandrel.

This mandrel has upper and lower threads 32 for connection in a well tubing string, a tube section 33, an upper body section 34, a lower body section 35 and a longitudinal flow passage 36. Centrally disposed in tube section 33 is an inner tube 37, connected in tube section boss 33*a* with threads to form annulus 39 with the inside of tube 33. The inner tube is provided with an enlarged upper end 37*a*, a downwardly and inwardly inclined surface 37*b* and slots 37*c*. Optional ports 37*d* are shown in the wall of tube 37. Drain ports 33*b* are provided for draining annulus 39 into inside of upper body section 34 of mandrel 18.

The mandrel lower body section 35 has a bore 35*a* concentric with flow passage 36, an offset receptacle having bore 35*b*, an internal shoulder 35*c* and a surface 35*d*. Centrally positioned in bore 35*a* is a lower inner tube 40, connected in the lower body with thread 41 to form annulus 42 with bore 35*a*. Ports 35*e* are provided to communicate bore 35*a* and passage 36 with bore 35*b*. Tube 40 has an upper enlargement 40*a*, a downwardly and inwardly tapering surface 40*b*, slots 40*c*, internal threads 40*d* and wall ports 40*e*.

When mandrel 17 (FIGS. 2A and 2B) is connected into a well tubing string and steam is injected into the tubing, some steam condenses into hot water on the cool tubing walls and runs down the tubing clinging to the inside forming a fluid film or "sheath". The hot water from tubing above runs down between the outside of enlargement 28*a* and the inside of tube 20, through slots 28*c* and collects on boss 20*a* to run through ports 31 or around on boss 20*a* and then through ports 31. As shown in FIG. 3, angle A may extend from a minimum of about 20° either side of a diameter opposite offset bore 22*b*, to a maximum of about 90° either side the diameter. The number and diameter of ports 31 and angle A may be varied as conditions require.

The central steam flow downwardly into mandrel 17 impinges on tube surface 28*b* and the bottoms of slots 28*c* to be deflected inwardly, mixed and continue downwardly into the inner tube section having threads 28*d* and ports 28*e*. Rotation is imparted to the outer steam column by the thread helix as it flows through the threads and any wetter steam or liquid moved outwardly by the rotational forces may flow through ports 28*e* into annulus 30 and downward through ports 31. Threads 28*d* may vary in profile, pitch, length and level of threaded section and ports 28*e* may be varied in size, number and placement for best separation of water from steam flowing down through tube 28 and for flow through ports 28*e* into annulus 30. As ports 31 are opposite offset receptacle bore 22*b* in the mandrel 17, the hot water down flow clings to the wall away from the receptacle bore and flow is directed to pass the receptacle in longitudinal flow passage 23 and downward out the lower mandrel end. Any steam vapor flowing downwardly from the lower end of inner tube 28 will be displaced laterally by hot water flow and flow toward and through offset receptacle bore 22*b* to exterior of the mandrel. When there is a flow control device 24, as shown in FIG. 2B and FIG. 4, latched and sealed in the receptacle bore, steam will flow through ports 27 and inlet port 24a through the device and out outlet 24b into bore 22b and exterior of the mandrel. Of course, if the control device houses a valve opened by pressure or contains an orifice, the injected steam must have sufficient pressure to flow through the orifice exterior of the mandrel or to open the valve to flow into bore 22b and exterior of the mandrel.

When mandrel 18 of FIGS. 5A & 5B is connected into a well tubing string and steam is injected into the tubing, some steam condenses into hot water on the cool tubing walls and runs down the tubing clinging to the walls in the form of a film or "sheath". The hot water sheath from the tubing above runs down between the outside of enlargement 37a and the inside of tube 33, through slots 37c into annular region 39 and drains through 360° around ports 33b into flow passage 36. Central steam flow entering the upper end of mandrel 18 and tube 33 impinges on tube surface 37b and the bottoms of slots 37c to be deflected inwardly, mixed and continue downwardly in tube 37. Optional ports 37d may be included in tube 37 in a desired number, diameter and placement to aid in draining any condensed hot water from the inside of tube 37 into annulus 39.

As drain ports 33b are 360° around, the sheath of hot water drains into flow passage 36 through ports 33b and runs downwardly clinging to the inside walls of body section 34 or falling through flow passage 36 into the annular opening between tube enlargement 40a and lower body section bore 35a and through slots 40c into annulus 42.

The number, spacing and diameter of ports 33b may be varied to direct hot water toward the offset receptacle. Larger ports on the offset receptacle side will direct more hot water toward the receptacle. Some hot water will fall into receptacle bore 35b and flow out of the mandrel if there is no flow control in the receptacle. If there is a control device such as 24 set in the receptacle bore 35b, hot water will fall or run down the body wall onto surface 35d (shown in FIGS. 5B and 6) and then into annulus 42.

Central steam flow downwardly through flow passage 36 impinges on tube surface 40b and the bottoms of slots 40c to be deflected inwardly, mixed and continue downwardly into the inner tube section having threads 40d and ports 40e. Rotation is imparted to the outer steam column by the thread helix as the steam column flows through the threads, mixing the steam and any wetter steam or liquid moved outwardly by the rotational forces flows through ports 40e into annulus 42 and later through ports 35e into the offset receptacle. The drier steam flows out the lower end of tube 40 and of mandrel 18 and downwardly in the injection tubing.

Of course, threads 40d may be varied in profile, pitch, length and placement of threaded section in tube 40 and ports 40e may also be varied in size, number and placement in the tube for best mixing and hot water separation.

I claim:

1. A mandrel connectable in a conduit and having a longitudinal flow passage therethrough comprising:

(a) an upper tubular section having means therein for separating and collecting wetter steam and hot water from steam injected into said flow passage; and (b) a lower body section having a receptacle therein offset from said flow passage, said receptacle communicating said flow passage with the mandrel exterior and ports in said lower body communicating said receptacle with said flow passage, said tubular section also including means for directing the separated and collected wetter steam and hot water to flow toward said receptacle or said flow passage through said mandrel.

2. The mandrel of claim 1 wherein the flow separating and collecting means is an inner tube, connected at its lower end in the mandrel tubular section to form an annulus therewith.

3. The mandrel of claim 2 wherein the means directing the collected wet steam and hot water flow are vertical ports through the mandrel tubular section communicating the annulus with the body interior.

4. The mandrel of claim 3 wherein the directing ports are spaced about one quarter to one half around the tubular section opposite the receptable to direct collected flow into the flow passage and through the mandrel.

5. The mandrel of claim 1 further including means in the receptacle for controlling flow from the longitudinal flow passage to exterior of said mandrel.

6. The mandrel of claim 5 wherein the means controlling flow is a valve.

7. The mandrel of claim 5 wherein the means controlling flow is a regulator.

8. The mandrel of claim 5 wherein the means controlling flow is a choke venturi.

9. The mandrel of claim 2 wherein the inner tube has an enlarged upper end and further includes means thereon said end for directing steam flow into said tube and mixing said flow.

10. The mandrel of claim 9 wherein the directing and mixing means on the inner tube is a downwardly and inwardly inclined surface.

11. The mandrel of claim 10 wherein there are slots through the surface extending into the tube, said slot bottoms inclining downwardly and inwardly.

12. The mandrel of claim 2 further including means in the inner tube for separating wetter steam and hot water from steam flowing downwardly in the inner tube.

13. The mandrel of claim 12 wherein the separating means are threads.

14. The mandrel of claim 13 wherein the inner tube has wall ports communicating the inside of the inner tube with the annulus.

15. The mandrel of claim 3 further including flow separator and collector means in the body adjacent the receptacle, for separating and collecting wetter steam and hot water from steam flow through the body.

16. The mandrel of claim 15 further including means in the receptacle for controlling flow from the longitudinal flow passage to exterior of the mandrel.

17. The mandrel of claim 16 wherein the means controlling flow is a valve.

18. The mandrel of claim 16 wherein the means controlling flow is a regulator.

19. The mandrel of claim 16 wherein the means controlling flow is a choke venturi.

20. The mandrel of claim 15 wherein the directing ports are spaced 360° around the tubular section and direct collected flow toward the receptacle.

21. The mandrel of claim 20 wherein the ports on the receptacle side of the mandrel are larger.

22. The mandrel of claim 20 wherein the tubular section inner tube has an enlarged upper end and further includes means thereon said end for directing steam flow into said tube and mixing said flow.

23. The mandrel of claim 22 wherein the directing and mixing means on the inner tube end is a downwardly and inwardly inclined surface.

24. The mandrel of claim 23 further including slots through the inclined surface extending into the tube, said slot bottoms inclining downwardly and inwardly.

25. The mandrel of claim 24 further including ports through the inner tube wall communicating the inside of the inner tube with the annulus.

26. The mandrel of claim 15 wherein the body separator and collector means comprise an inner tube in the longitudinal passage, connected at its lower end in the body to form an annulus therewith.

27. The mandrel of claim 26 wherein the inner tube has an enlarged upper end and includes means thereon said end for directing steam flow into said tube and mixing said flow.

28. The mandrel of claim 27 wherein the directing and mixing means on the inner tube end is a downwardly and inwardly inclined surface.

29. The mandrel of claim 28 further including slots through the inclined surface extending into the tube, said slot bottoms inclining downwardly and inwardly.

30. The mandrel of claim 26 including means in the inner tube for separating wetter steam and hot water from steam flowing downwardly in the inner tube.

31. The mandrel of claim 30 wherein the separating means are threads.

32. The mandrel of claim 31 further including ports through the inner tube wall communicating the inside of the inner tube with the annulus.

33. A method of selectively providing steam or wet steam and hot water to one or more formations in an enhanced oil recovery injection well simultaneously comprising the steps of:

(a) drilling a hole through earth formations containing viscous petroleum deposits;

(b) running casing into said hole and perforating said casing at selected intervals adjacent each said formation;

(c) running one or more tubing strings into said casing having a selected mandrel or selected spaced apart mandrels and a packer therein above each mandrel, each said mandrel having means therein for separating and collecting wetter steam and water from steam injected into said tubing string and directing said collected steam and water exterior of or through each said mandrel; and (d) operating said packers to seal above and between each formation and provide separate sealed tubing casing annular regions exterior of each of said mandrels, each said region communicating through a perforated interval with a formation.

34. The method of claim 33 wherein means is provided in each mandrel for controlling flow exterior of the mandrel.

35. The method of claim 34 wherein the means controlling flow is a valve.

36. The method of claim 34 wherein the means controlling flow is a regulator.

37. The method of claim 34 wherein the means controlling flow is a choke venturi.

38. The method of claim 33 wherein the tubing string includes a packer therein above more than one mandrel for each annular region.

39. The method of claim 38 wherein means is provided in each mandrel for controlling flow exterior of the mandrel.

40. The method of claim 39 wherein the means controlling flow is a valve.

41. The method of claim 39 wherein the means controlling flow is a regulator.

42. The method of claim 39 wherein the means controlling flow is a choke venturi.

43. The method of claim 33 wherein each tubing string further includes at the surface a flow meter, a temperature gage and a pressure gage.

44. A well system for selectively providing steam or wet steam steam and hot water for simultaneous injection into one or more formations in an enhanced oil recovery injection well comprising:

(a) casing in the well, said casing having perforations at intervals communicating each formation with the interior of said casing; and (b) one or more tubing strings in said casing, each said tubing string having a selected mandrel or mandrels for each formation with means in each mandrel for separating, collecting and directing steam or wet steam and hot water into the interior of said casing or through each mandrel, said tubing string having a packer set above and between each said formation to provide separate sealed tubing casing annular regions in said casing for each formation.

45. The well system of claim 44 wherein each mandrel further includes means therein for controlling flow into the interior of the casing.

46. The system of claim 45 wherein the means controlling flow is a valve.

47. The well system of claim 45 wherein the means controlling flow is a regulator.

48. The system of claim 45 wherein the means controlling flow is a choke venturi.

49. The well system of claim 44 wherein the tubing string includes more than one selected mandrel for each formation.

50. The well system of claim 49 wherein each mandrel further includes means therein for controlling flow into the interior of the casing.

51. The well system of claim 44 wherein each tubing string further includes at the surface a flow meter, a temperature gage and a pressure gage.

52. The system of claim 50 wherein the means controlling flow is a valve.

53. The system of claim 50 wherein the means controlling flow is a regulator.

54. The system, of claim 50 wherein the means controlling flow is a choke venturi.

* * * * *